US008932096B2

(12) United States Patent
Ford et al.

(10) Patent No.: US 8,932,096 B2
(45) Date of Patent: Jan. 13, 2015

(54) LIFE VEST WITH RETRIEVAL DEVICE

(71) Applicant: Carleton Technologies, Inc., Orchard Park, NY (US)

(72) Inventors: Brian Ford, Seminole, FL (US); Matt Scholes, Germantown, TN (US); M. Elizabeth Bolint, Tampa, FL (US); Donald Blackman, Bradenton, FL (US)

(73) Assignee: Carleton Technologies, Inc., Orchard Park, NY (US)

( * ) Notice: Subject to any disclaimer, the term of this patent is extended or adjusted under 35 U.S.C. 154(b) by 134 days.

(21) Appl. No.: 13/760,713

(22) Filed: Feb. 6, 2013

(65) Prior Publication Data

US 2014/0220838 A1 Aug. 7, 2014

(51) Int. Cl.
*B63C 9/26* (2006.01)
*B63C 9/18* (2006.01)

(52) U.S. Cl.
CPC ..... *B63C 9/18* (2013.01)
USPC ..... 441/80; 441/84

(58) Field of Classification Search
USPC ..... 441/80, 84; 114/80, 84
IPC ..... B63C 9/26
See application file for complete search history.

(56) References Cited

U.S. PATENT DOCUMENTS

| | | | | |
|---|---|---|---|---|
| 4,560,356 | A * | 12/1985 | Burr | 441/80 |
| 5,441,006 | A * | 8/1995 | Wood | 114/220 |
| 6,394,867 | B1 * | 5/2002 | Bianco | 441/126 |
| 2007/0056500 | A1 * | 3/2007 | Beck | 116/210 |

* cited by examiner

*Primary Examiner* — Stephen Avila
(74) *Attorney, Agent, or Firm* — Jaeckle Fleischmann & Mugel, LLP

(57) ABSTRACT

Disclosed is a personal flotation and rescue device. The device includes a life vest with an interconnected backpack. The backpack includes an interior area that is enclosed by a peripheral zipper. A boom is initially stored within the backpack in an uninflated and accordion-like state. A water activated inflator is secured to the boom and is adapted to fully inflate the boom upon contact with water. Inflation of the boom causes the zipper to open and thereby permit the boom to be fully extended from the back of the wearer. Joints are included along the length of the boom such that it takes on a bounded configuration after inflation. The bounded area and then be used by rescue personnel in retrieving the wearer of the device.

8 Claims, 6 Drawing Sheets

LIFE VEST WITH RETRIEVAL DEVICE

TECHNICAL FIELD

This disclosure relates to a life vest. More specifically, the present disclosure relates to a life vest with an inflatable boom that allows for the retrieval of its wearer.

BACKGROUND OF THE INVENTION

Life vests and life preservers are important pieces of equipment for individuals who work on or around the water. Life vests are generally positioned around a wearer's neck and are formed from a buoyant material. Life vests are particularly important in the event the wearer is unconscious or otherwise immobilized. In such situations, life vests not only prevent drowning, but they also allow the wearer to remain above the water where they are both visible and accessible by rescue personnel.

Problems arise, however, when the wearer of a life vest is located in a dangerous or difficult to reach area. Although the individual may remain afloat and visible, rescue personnel cannot reach the person to pull him or her to safety. This situation may arise, for example, when an individual falls from an offshore oil platform. Oil platforms are often located in deep seas and may rise several stories over the surface of the water. Individuals who fall from these platforms are often incapacitated or unconscious. Yet, the area around the base of the platform can prove extremely dangerous to rescue personnel. In rough seas such areas are inaccessible by rescue vessels.

What is needed, therefore, is a life vest that includes an extendible or inflatable boom that can be grabbed or otherwise accessed by rescue personnel. The boom would thereby permit rescue personnel to retrieve the wearer of the lift vest without having to be near the person. The present disclosure is aimed at fulfilling these and other needs.

SUMMARY OF THE INVENTION

This disclosure relates to a personal flotation rescue device that includes an inflatable boom that permits a wearer of the device to be pulled to safety by rescue personnel.

The present device has several important advantages. For example, the boom does not need to be manually activated. Rather, the boom is automatically deployed upon contact with water.

A further possible advantage is realized by forming joints along the length of the boom, thereby allowing the boom to form a bounded area when inflated. This bounded area can be easily viewed and accessed by rescue personnel.

Still yet another advantage of the present device is achieved by initially storing the boom within a backpack associated with the device, thereby keeping the boom out of the way until needed.

Another advantage of the present device is realized by including a zippered closure that is designed to be ruptured upon inflation of the boom.

Various embodiments of the invention may have none, some, or all of these advantages. Other technical advantages of the present invention will be readily apparent to one skilled in the art.

BRIEF DESCRIPTION OF THE DRAWINGS

For a more complete understanding of the present disclosure and its advantages, reference is now made to the following descriptions, taken in conjunction with the accompanying drawings, in which.

Figure 1:
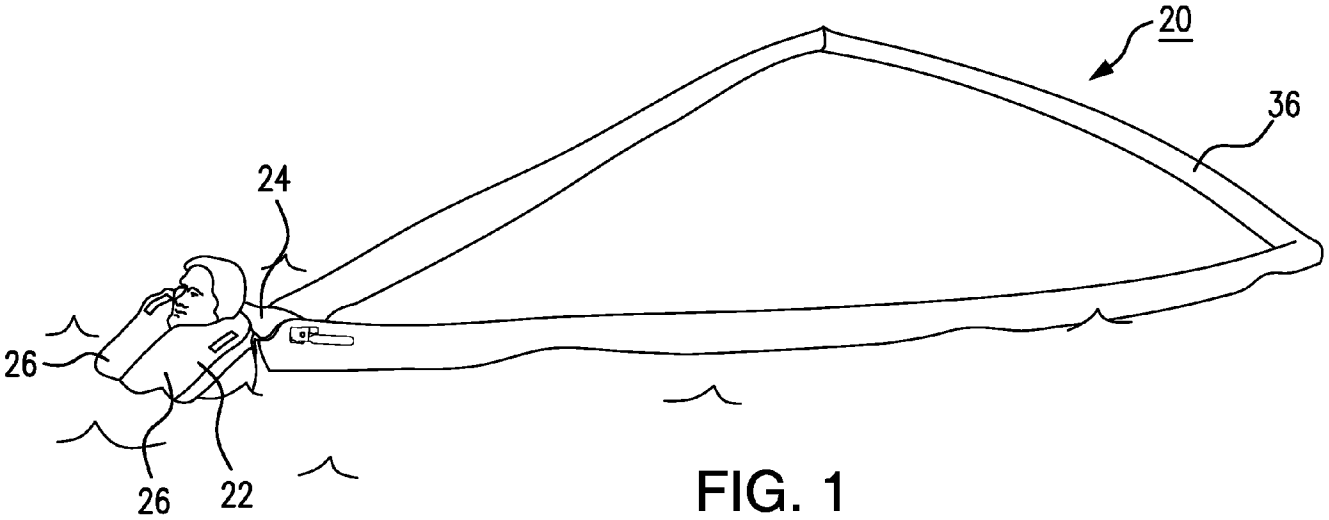
FIG. 1 is a perspective view of the boom in the inflated and deployed orientation.

| Parts List | |
|---|---|
| 20 | Device |
| 22 | Front |
| 24 | Rear |
| 26 | Panels |
| 28 | Backpack |
| 32 | Interior Area of Backpack |
| 34 | Zippered Closure |
| 36 | Boom |
| 38 | Seam of Boom |
| 42 | Base of Boom |
| 44 | Joints in Boom |
| 46 | Stitching in Joint |
| 48 | Valve |
| 52 | Tether |
| 54 | $1^{st}$ End of Tether |
| 56 | $2^{nd}$ End of Tether |
| 58 | Inflator |
| 62 | Alternative Embodiment |
| 64 | Life Rings |
| 66 | Tethers |
| 70 | Grommet Holes |
| 72 | Additional Embodiment |
| 75 | Additional Boom |

DETAILED DESCRIPTION OF THE DRAWINGS

The present disclosure relates to a personal flotation and rescue device. The device includes a life vest with an interconnected backpack. The backpack includes an interior area that is enclosed by a peripheral zipper. A boom is initially stored within the backpack in an un-inflated and accordion-like state. One or more water activated inflators are secured to the boom and are adapted to fully inflate the boom upon contact with water. Inflation of the boom causes the zipper to open and thereby permit the boom to be fully extended from the back of the wearer. Joints are included along the length of the boom such that it takes on a bounded configuration after inflation. The bounded area and then be used by rescue personnel in retrieving the wearer of the device. The various components of the present invention, and the manner in which they interrelate, are described in greater detail hereinafter.

Device 20 includes interconnected front and rear portions (22 and 24) that together form a vest that can be positioned over the head of the user. Front portion 22 includes a life vest that inflates upon contact with water. Rear portion 24 includes a backpack 28. Backpack 28 includes an interior area 32 that is bounded by a zippered closure 34. As described hereinafter, zipper 34 is designed to be water permeable to allow water to enter into interior area 32 when submerged. Alternatively, backpack 28 may include apertures 70 to allow water to enter area 32. Furthermore, zipper 34 is designed to be opened upon inflation of boom 36. Suitable zippers are commercially available from YYK Group of Tokyo, Japan. Furthermore, the backpack 28 can be incorporated into any of a variety of commercially available flotation vests. One suitable supplier is Life Savings Systems Corp. of Apollo Beach, Fla.

The inflatable boom 36 is initially stored within the interior area 32 of backpack 28 in an un-inflated state. In the preferred embodiment, boom 36 is folded into a compact, accordion-like shape. Boom 36 can be formed from any of a variety materials. However, the preferred material is a polyurethane coated nylon material. Boom 36 is formed by folding the material in half and joining the two edges via an airtight weld to form a seam 38. Seam 38 extends the full length of boom 36. In the preferred embodiment, seam 38 is formed via radio frequency welding. The opposing ends of the boom 36 are likewise joined or sewn together at a base portion 42. As such, boom 36 is formed in a closed loop. With the ends and seam 38 fully sealed, the interior of the boom forms an airtight chamber.

Figure 2:
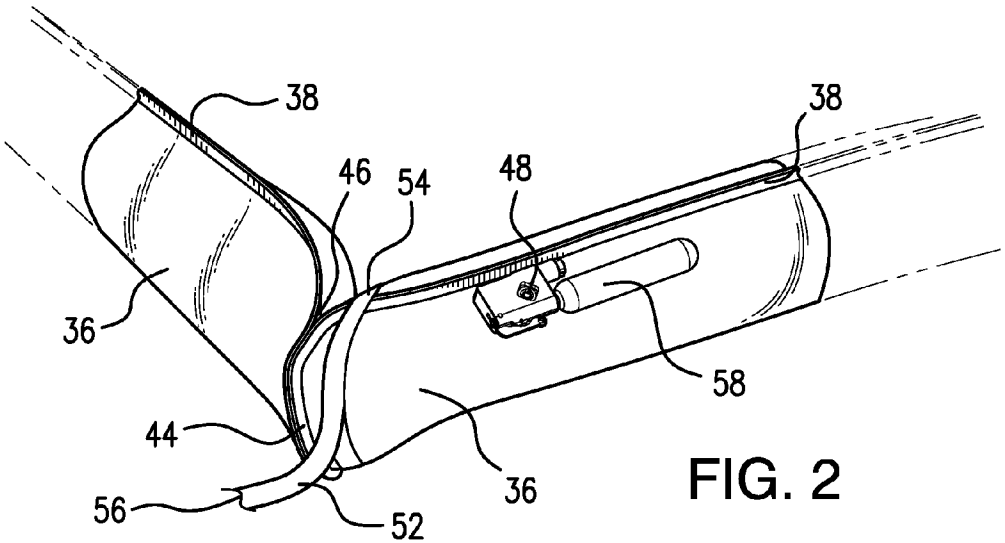
FIG. 2 is a detailed view of the inflator associated with the boom.
Figure 2A:
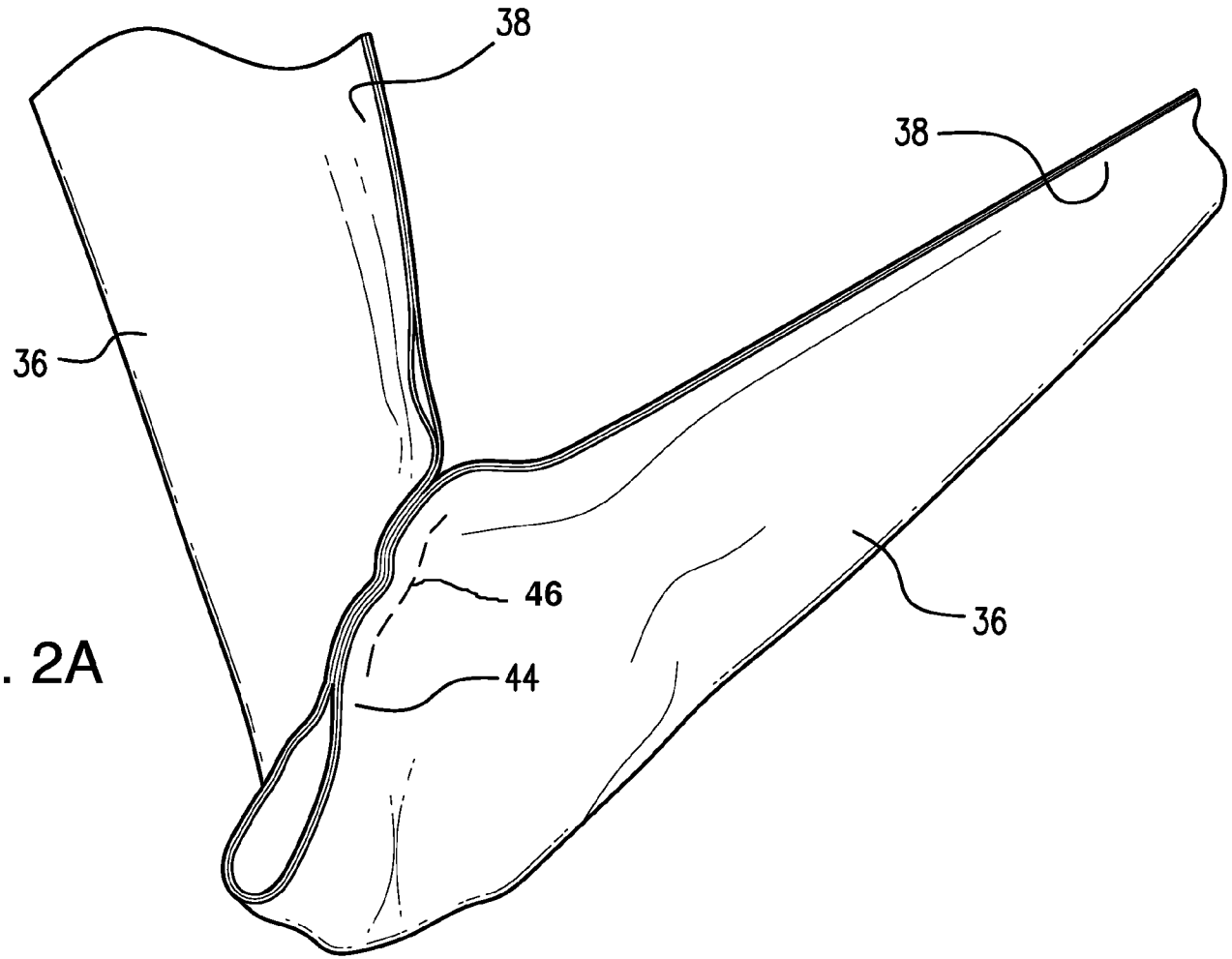
FIG. 2A is detailed view of one of the joints in the boom.
Figure 3:
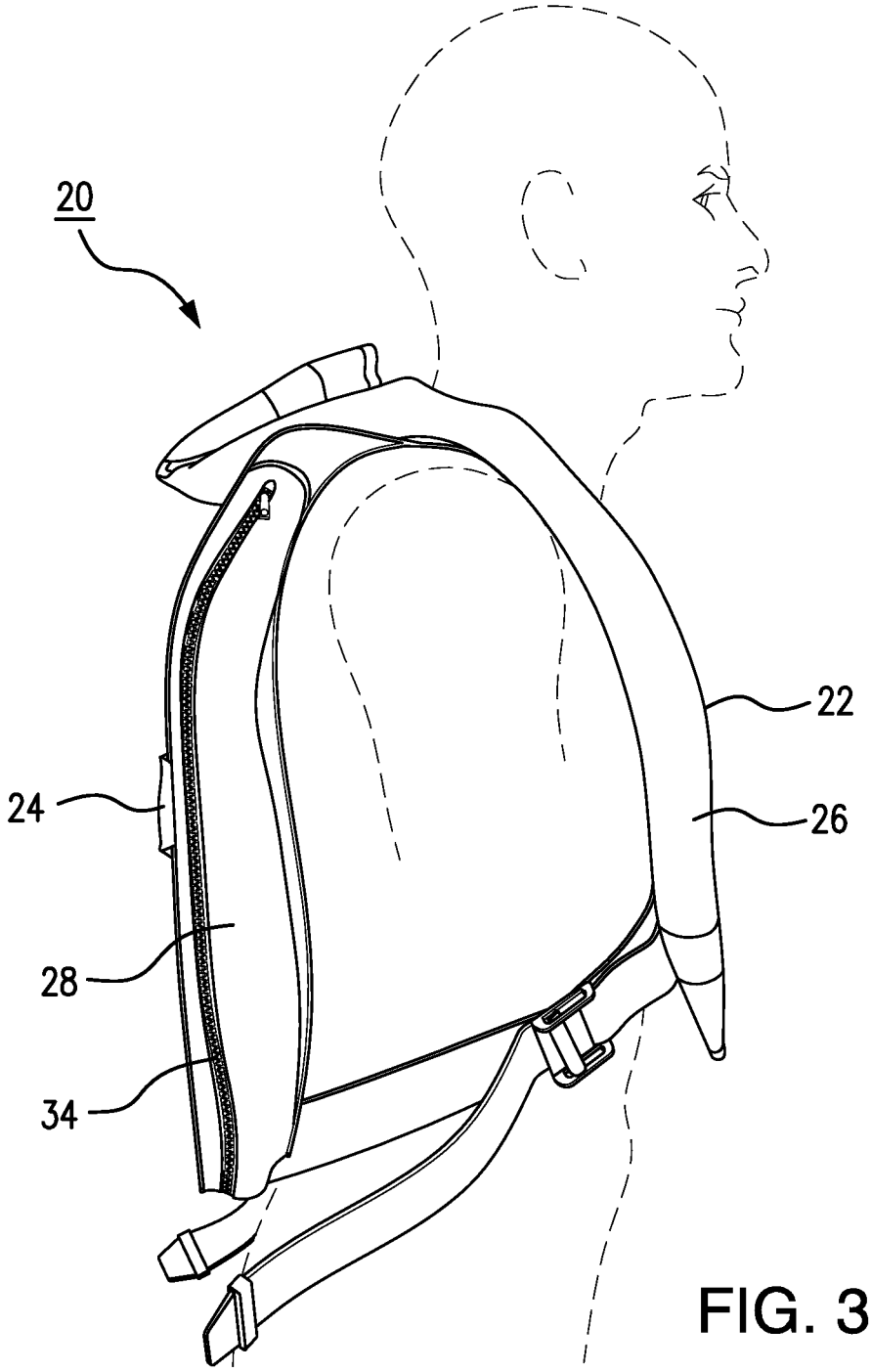
FIG. 3 is a side view of the device with the backpack in the closed configuration.

In an important aspect of the invention, a series of joints 44 are formed along the length of boom 36. Joints 44 are ideally made by pinching together adjacent portions of the seam 38. The joined seams 38 are then sewn to form an angle along boom 36. The stitching 46 used to form the joint 44 is most clearly shown in FIG. 2*a*. In the preferred embodiment illustrated in FIG. 1, two joints 44 are formed along the length of boom 36. A further angle is formed at the location where the two ends of boom 36 are joined together at base 42 (note FIG. 2). As such, once inflated, the boom takes on a three sided triangular configuration with each of the angles generally being less than approximately 90°. However, any number of different configurations can be formed by adding additional joints 44 along the length of boom 36 as desired. A pneumatic valve 48 is secured through the fabric of boom 36 to provide a fluid channel into the airtight chamber within boom 36. In the preferred embodiment, a Schrader-type valve is included. If desired, more than one valve 48 may be provided to permit the rapid inflation of boom 36.

Figure 4:
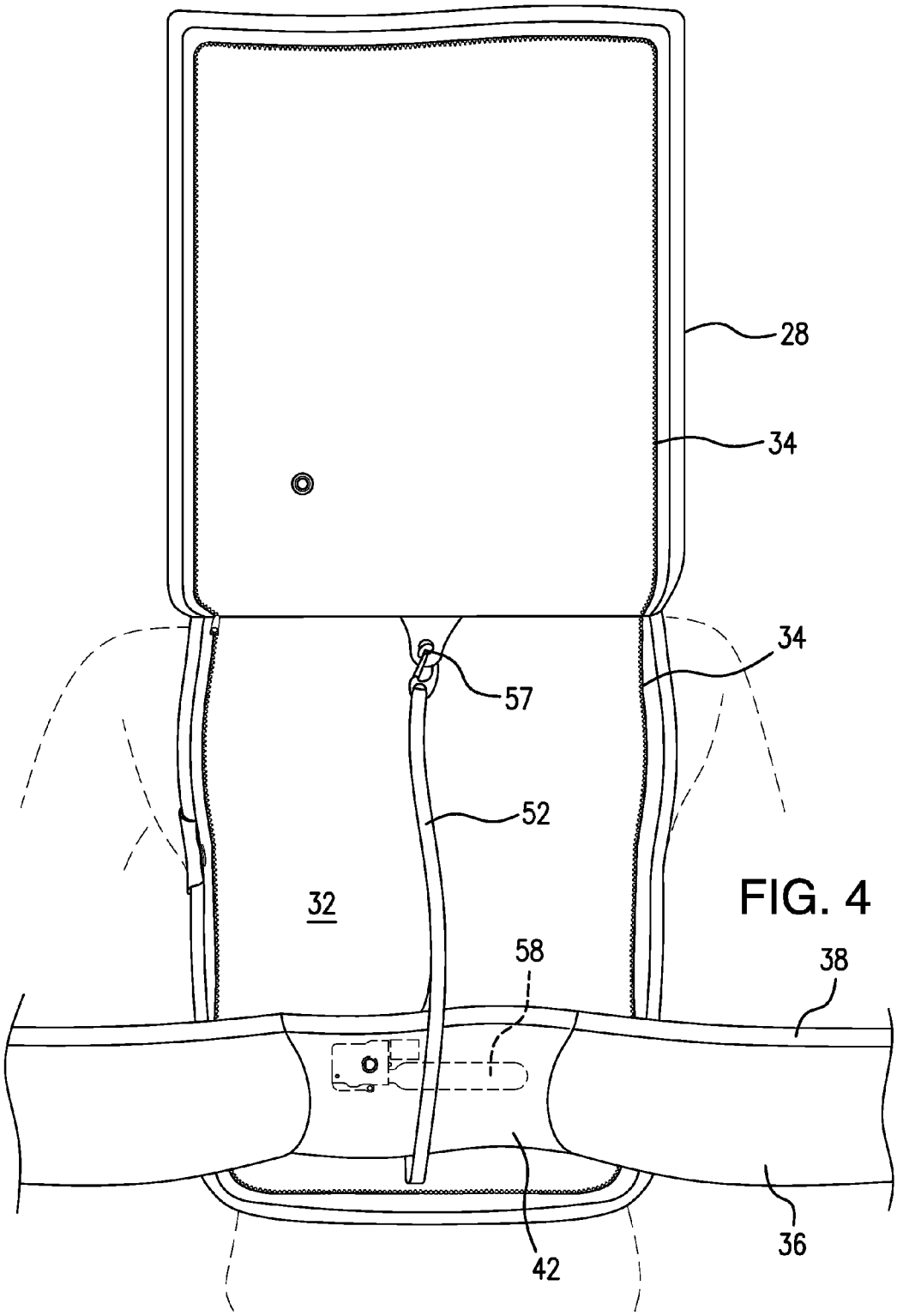
FIG. 4 is a rear view of the device with the backpack in the opened orientation and with the boom inflated and deployed.

Boom 36 is secured to the remainder of device 20 via a tether 52. Preferably a nylon tether 52 is included. The first end 54 of tether 52 is looped around the base portion 42 of boom 36. Tether 52 can likewise be secured to other locations along boom 36. The second end 56 of tether 52 is secured to the interior area 32 of backpack 28 via a fastener 57 (note FIG. 4). This fastener 57 may be, for example, a conventional snap-type fastener. The fastener permits the user to uncouple backpack 28 from boom 36 if needed.

Device 20 further includes a water activated inflator 58 that is secured to valve 48. Again, multiple inflators 58 and multiple valves 48 can be included. The number of inflators 58 and valves 48 used will depend upon the size of the inflators 58 used, the volume of the boom 36, and the speed with which the boom 36 is to be inflated. Water activated inflators are known in the art and any number of which can be used in connection with the present invention. Water activated inflators are commercially available from Halkey-Roberts Corporation of St. Petersburg, Fla. Inflator(s) 58 can be located anywhere along the length of boom 36. In the preferred embodiment, the inflator(s) 58 is located along base portion 42 of boom 36 (note FIG. 4).

In use, when device 20 is immersed in water, water enters interior area 32 of backpack 28 via zipper 34 and grommet holes 70. The water thereafter activates inflator 58 to inflate boom 36. Inflation of boom 36, in turn, causes zipper 34 to open. This allows boom 36 to fully expand and form a bounded area. The bounded area forms a target that can be used by the rescue personnel in retrieving the wearer. Namely, a grappling hook can be launched into the area bounded by boom 36.

Figure 5:
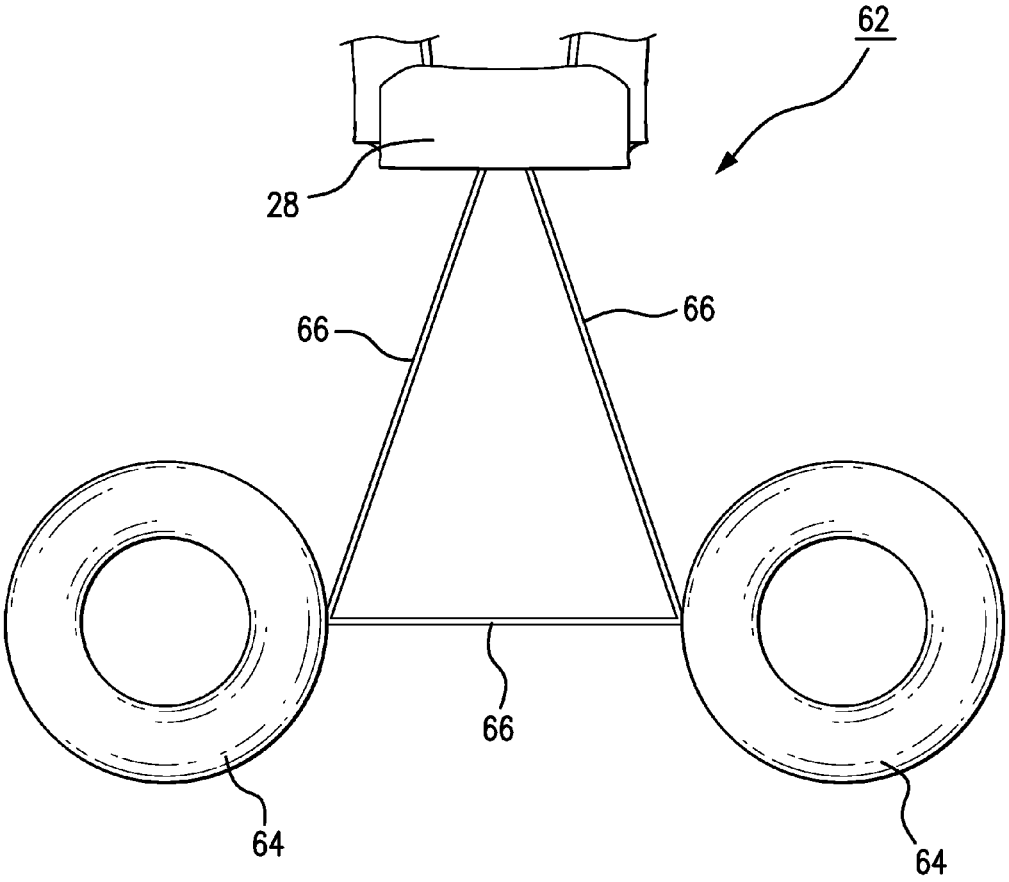
FIG. 5 is an alternative embodiment of the present disclosure.

An alternative embodiment 62 is shown in FIG. 5. Here, inflatable boom 36 is replaced by two water activated inflatable life rings 64. Rings 64 are initially stored in the backpack 28 in a deflated state. As noted above, these life rings 64 would be inflated by a small water activated inflator 58. A series of three tethers 66 (or cables) would interconnect the life rings 64 and backpack 28 in a triangular configuration. Namely, a first tether 66 would connect backpack 28 to the first life ring 64; a second tether 66 would connect backpack 28 to the second life ring 64; and a third tether 66 would interconnect the two life rings 64. Each tether 66 would preferably include an interior core formed from a coiled carbon fiber or fiberglass rod. A grabbing hook could be thrown or fired into the triangle formed by the tethers. This would allow the victim to be held in place until a rescue could occur. Alternatively, the grabbing hook could be used to pull the victim to safety.

Figure 6:
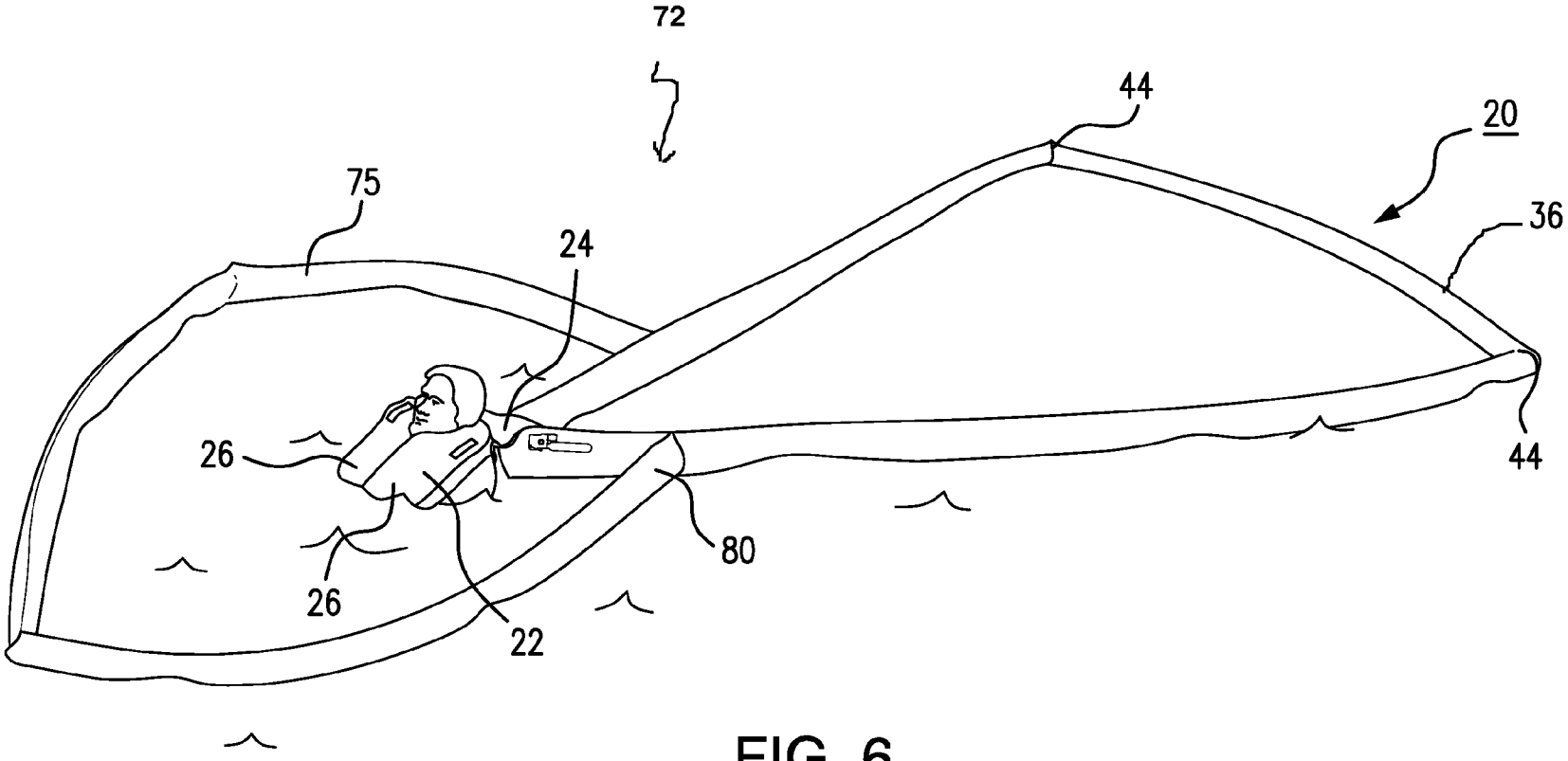
FIG. 6 is a further alternative embodiment of the present disclosure.

Another alternative embodiment 72 is shown in FIG. 6. Here, an additional inflatable boom 75 is joined to inflatable boom 36. This is accomplished by radio frequency welding boom 75 to boom 36 to create a passageway for the gas. Inflatable boom 75 is a secondary boom that deploys around the individual wearing the life vest. When inflated, such system 72 offers the ability to completely surround the victim. Thus, if oil or other hazardous materials are floating on the water, booms 75 and 36 prevent them from immediately reaching the victim.

Although this disclosure has been described in terms of certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure.

What is claimed is:

1. A safety device that permits a wearer to be retrieved from water by rescue personnel, the safety device comprising:

a life vest including two buoyant front panels and a backpack, the backpack including an interior area and a zippered peripheral region, the zippered peripheral region being water permeable upon immersion into water;

an inflatable boom stored within the interior area in an accordion like manner, the boom being formed from a length of polyurethane coated nylon that is folded and joined along a seam via radio frequency welding, the interior of the boom forming an airtight chamber, the boom including opposing ends that are joined to together, the boom further including a plurality of joints that are formed by sewing together adjacent portions of the seam, a Schrader valve formed along the length of the boom and providing a fluid connection to the interior of the boom;

a tether including first and second ends and an intermediate extent therebetween, the first end being secured about the inflatable boom, a fastener securing the second end of the tether to the interior area of the backpack; and a water activated inflator secured to the Schrader valve, the inflator being activated upon contact with the water to fully inflate the boom;

wherein when the life vest is immersed in water, water enters the interior area of the backpack via the zippered peripheral region, the water thereafter activating the inflator to inflate the boom, inflation of the boom causing the zipper to open, the joints causing the boom to form a bounded area when inflated, the bounded area arranged to be used by the rescue personnel in retrieving the wearer.

2. A safety device that permits a wearer to be retrieved from water by rescue personnel, the safety device comprising:

a life vest including a backpack including an interior area and a peripheral region, the peripheral region being water permeable upon immersion into water;

an inflatable boom stored within the interior area, the interior of the boom forming an airtight chamber, the boom including opposing ends that are joined together, the boom further including a plurality of joints, a valve formed along the length of the boom and providing a fluid connection to the interior of the boom;

a tether including first and second ends and an intermediate extent therebetween, the first end being secured to the inflatable boom, the second end being secured to the interior area of the backpack; and a water activated inflator secured to the valve, the inflator being activated upon contact with the water;

wherein when the life vest is immersed in water, water enters the interior area of the backpack via the peripheral region, the water thereafter activating the inflator to inflate the boom, the joints causing the boom to form a bounded area when inflated, the bounded area arranged to be used by the rescue personnel in retrieving the wearer.

3. The device as described in claim 2 wherein the peripheral area of the backpack includes a zipper, the zipper being opened upon inflation of the boom.

4. The device as described in claim 2 further included a life vest interconnected to the backpack and adapted to be worn on the wearer's chest.

5. The device as described in claim 2 wherein the boom is formed from a length of polyurethane coated nylon that is folded and joined along a seam via radio frequency welding.

6. The device as described in claim 2 wherein the joints are formed by sewing together adjacent portions of the seam.

7. The device as described in claim 2 wherein the inflatable boom is a primary boom and further comprising a secondary boom that is in fluid communication with the primary boom.

8. The device as described in claim 7 wherein the secondary boom inflates to an orientation that completely surrounds the individual wearing the life vest to thereby keep hazardous materials away from the individual.

* * * * *